US006679205B2

(12) United States Patent
Morikami

(10) Patent No.: US 6,679,205 B2
(45) **Date of Patent: *Jan. 20, 2004**

(54) CONTROL SYSTEM AND CONTROL METHOD OF ENGINE

(75) Inventor: Tadaaki Morikami, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/022,408

(22) Filed: Dec. 20, 2001

(65) Prior Publication Data

US 2002/0078911 A1 Jun. 27, 2002

(30) Foreign Application Priority Data

Dec. 21, 2000 (JP) ..... 2000-389232
Dec. 21, 2000 (JP) ..... 2000-389233

(51) Int. Cl.[7] ..... F01L 1/34
(52) U.S. Cl. ..... 123/90.15; 123/90.17; 123/348
(58) Field of Search ..... 123/90.15, 90.16, 123/90.17, 339.1, 339.14, 339.15, 339.16, 348

(56) References Cited

U.S. PATENT DOCUMENTS 4,271,402 A * 6/1981 Kastura et al. ..... 340/459
4,354,238 A * 10/1982 Manaka et al. ..... 701/104
4,682,044 A * 7/1987 Hotate et al. ..... 290/40 B
5,024,199 A * 6/1991 Abe ..... 123/489
5,590,630 A * 1/1997 Kurihara et al. ..... 123/339.17
5,967,125 A * 10/1999 Morikawa ..... 123/520
5,975,066 A * 11/1999 Morikami ..... 123/674
6,039,032 A * 3/2000 Morikawa et al. ..... 123/520
6,119,653 A * 9/2000 Morikami ..... 123/339.23
6,234,144 B1 * 5/2001 Yamaguchi et al. ..... 123/399
6,470,852 B1 * 10/2002 Kanno ..... 123/339.23
6,474,298 B2 * 11/2002 Kanno ..... 123/339.14
6,481,411 B1 * 11/2002 Katayama ..... 128/339.23
6,491,032 B1 * 12/2002 Kanno ..... 123/680

OTHER PUBLICATIONS

U.S. patent application Ser. No. 10/022,865, filed Dec. 20, 2001, pending.
U.S. patent application Ser. No. 10/022,408, filed Dec. 20, 2001, pending.

* cited by examiner

*Primary Examiner*—Thomas Denion
*Assistant Examiner*—Ching Chang
(74) *Attorney, Agent, or Firm*—Oblon, Spivak, McClelland, Maier & Neustadt, P.C.

(57) ABSTRACT

In an engine having an intake device provided with a solenoid valve, an amount of intake air is controlled on a basis of a duty control by means of a control unit, and the control unit includes an element for recognizing a state which is evidently different from a normal state to thereby stationarily hold a duty of the solenoid valve at a necessary set value.

19 Claims, 8 Drawing Sheets

FIRST EXAMPLE OF BASIC MAP AT A TIME OF FULL-CLOSE SWITCH "OFF"

| REVOLUTION NUMBER Ne(rpm) | 500 | 750 | 1000 | 1250 | 1500 | 1750 | 2000 |
|---|---|---|---|---|---|---|---|
| CONTROL DUTY Duty(%) | 20→5 | 35→20 | 50→35 | 65→50 | 80→65 | 90→75 | 100→85 |

MAP OFFSET BASIC POINT(ON→OFF TIME)  OFFSET MAP DATA

SECOND EXAMPLE OF BASIC MAP AT A TIME OF FULL-CLOSE SWITCH "OFF"

| REVOLUTION NUMBER Ne(rpm) | 500 | 750 | 1000 | 1250 | 1500 | 1750 | 2000 |
|---|---|---|---|---|---|---|---|
| CONTROL DUTY Duty(%) | 5→20 | 15→30 | 25→40 | 35→50 | 45→60 | 55→70 | 65→80 |

CONTROL SYSTEM AND CONTROL METHOD OF ENGINE

BACKGROUND OF THE INVENTION

1. Field of the Invention

The present invention relates a control system of an engine and also relates to a control method of the engine.

2. Description of the Related Art

An engine generally has an intake device, which is provided with a solenoid valve to control an amount of intake air on the basis of a 'DUTY CONTROL' (herein, merely called "duty control"), in order to make idling of the engine stable and improve starting performance.

It is necessary to perform an initial setting of an amount of intake air periodically to increase the above-mentioned performance to at least a certain level. Such an initial setting (initializing) operation generally requires a duty tester and the other exclusive tools.

However, all the dealers and maintenance facilities do not necessarily always have the duty tester and the other exclusive tools. In addition, any user will also not have them individually. As a result, there is a restriction in the initial setting operation and too much expenses are required. Moreover, the initializing operation is also required when shipping the engine from a manufacturing plant, and the use of the duty tester and the other exclusive tools will deteriorate the workability.

In view of such circumstances, there may be adopted measures to make an indirect duty adjustment, without using any exclusive tools, by for example closing an intake port of the solenoid valve with a finger and turning, in such a state, an air bypass screw to adjust a bypass flow rate so as to adjust the revolution number to a level, which is lower than the target revolution number. In such a case, a careful adjusting operation is required, it is not easy to carry out such an adjusting operation and the adjusting operation does not necessarily provide good results.

Further, when the amount of air is adjusted to a side relying on the solenoid, i.e., a side of a high-solenoid duty, there occurs an inconvenience such as of deteriorated starting performance, stall at a time of conducting a sudden completely closing operation, increase in power consumption, and so on.

On the other hand, when the amount of air is adjusted to an opposite side to the side relying on the solenoid, i.e., a side of a low-solenoid duty, an excessive amount of air may deteriorate reduction in revolution number of the engine during deceleration, causing difficulty in a shifting operation or increase the revolution number in an idling state, deteriorating the rate of fuel consumption. With respect to an engine of an outboard motor, for example, the engine operates in the idling state to carry out a trolling. Increase in the revolution number in the idling state makes the speed of a boat faster, thus deteriorating maneuvering properties of the boat.

In either case mentioned above, an inappropriate adjustment will not provide a full performance of the engine.

Furthermore, as mentioned hereinbefore, the intake device of the engine is provided with a solenoid valve to control an amount of intake air on the basis of a duty control so as to make idling of the engine stable and improve starting performance.

Such solenoid valve is controlled so that the revolution number of the engine becomes an aimed revolution number except for a case of full-close state of a throttle valve or starting and dashpot mode.

On the other hand, in the case of not full-close state of the throttle valve, the duty is regulated on a predetermined map so as not to be delayed through a dashpot control at a time of rapid full-close operation.

Furthermore, the solenoid valve of the engine is also controlled, even in the full-close state, in a range not causing a problem in the stating characteristic, rotation-down, engine stall or like at the dashpot control time.

However, the adjustment or control mentioned above is not always performed and, in practical, is carried out only at a time of inspection of the engine or occurrence of an inconvenient matter. Accordingly, there causes a difference between the preliminarily adjusted air amount and an air amount actually required for the engine in accordance with aged deterioration, degradation of lubrication oil, friction change or like.

For example, in a case where a sensor utilized for the control is a full-close switch performing "ON" operation at a full-close time of a throttle valve disposed inside a throttle body, a revolution number feed-back function is caused at the full-close time and no problem is, hence, caused. However, in "OFF" state of the full-close switch, i.e., in a case where the full-close switch is even little opened, the duty is controlled on the preliminarily determined map, so that there may cause a case that the revolution number of the engine is increased or decreased at the ON-OFF switching point of the full-close switch.

For example, in a case where the duty at the time of feed-back in the "ON" state of the full-close switch is set to be higher than a duty in the "OFF" state thereof, the air amount is reduced at the switching point (ON OFF) and the engine revolution number is suddenly lowered.

Furthermore, in a case where the throttle valve is returned slowly, there is a possibility of causing a case that an air amount is reduced just before the "ON" state of the full-close switch and the engine stall is caused.

On the other hand, in a case where the duty at the time of feed-back in the "ON" state of the full-close switch is set to be lower than a duty in the "OFF" state thereof, the air amount is increased at the switching point (ON OFF) and there may cause an inconvenience such that the engine revolution number is suddenly increased.

Even in a case where a throttle sensor for detecting a degree of throttle valve opening is utilized in place of the full-close switch operating at the open/close time of the throttle valve for the dashpot control or like, an inconvenient state substantially identical to that mentioned above will be caused at the switching point thereof because the throttle sensor is provided with an idle zone.

SUMMARY OF THE INVENTION

A primary object of the present invention is to substantially eliminate defects or drawbacks encountered in the prior art mentioned above and to provide control system and method of an engine, which permits to initialize easily an amount of intake air without using any exclusive tools in a reliable manner.

Another object of the present invention is to provide, in addition to the above, control system and method of an engine capable of preventing a change of revolution number of the engine at a switching (open/close) point of a throttle valve of the engine.

These and other objects can be achieved according to the present invention by providing, in one aspect, a control system of an engine, in which an intake device is provided with a solenoid valve and an amount of intake air is controlled on a basis of a duty control by an element of a control unit, wherein the control unit includes means for recognizing a state which is evidently different from a normal state to thereby stationarily hold a duty of the solenoid valve at a necessary set value.

According to this aspect, it is possible to easily initialize an amount of intake air with the use of a simple tool without considering the target amount of intake air and to prevent an engine stall from occurring during the adjustment operation.

In preferred embodiments of this aspect, the evidently different state from the normal state is caused by carrying out an operation for increasing a revolution number of the engine in a fully closed state of a throttle valve. A time elapsed is set for increase in the revolution number of the engine.

The evidently different state from the normal state is caused by carrying out an operation for setting a voltage level of a terminal in a harness to a level, which is different from a normal voltage level.

The evidently different state from the normal state is caused by carrying out a switching operation of a specific switch.

The duty is set to be held stationarily after the recognition of a warming up state of the engine. The duty may be set to be held stationarily after recognition that a shift device takes a neutral state in a shift position thereof.

An information that the duty is stationarily held is transmitted to an operator by at least either one of a display device and an audio response device.

An adjustment of the duty is automatically stopped after the engine is stably and continuously operated for a set period of time within a range of an error of a target revolution number.

An information on completion of an operation for stationarily holding the duty is transmitted to an operator by at least either one of a display device and an audio response device.

The engine is set to be stopped immediately after the operation for stationarily holding the duty is failed.

According to preferred embodiments, it is possible to prevent an amount of air from being erroneously held stationarily. It is also possible to make a set range of amount of air narrow, reducing the adjustment variation to the minimum. The safety during working can be ensured.

No exclusive tool is required to carry out an adjusting operation, thus further ensuring an easy working. Furthermore, it is possible to make easily adjustment and prevent the subjectivity of an operator from being incorporated into the working and to ensure safety of the operator.

In another aspect, there is provided a control method of an engine having an intake device provided with a solenoid valve and a control unit, wherein an amount of intake air is controlled on a basis of a duty control by the control unit, and a duty of the solenoid valve is stationarily held to a necessary set value through recognition, to the control unit, of a state which is evidently different from a normal state to thereby stationarily hold a duty at a necessary set value.

In a further aspect, there is also provided a control system of an engine having an intake device provided with a throttle body and a solenoid valve to control an amount of intake air on a basis of a duty control, wherein a full-close switch is kept in an "ON" position when a throttle valve mounted to the throttle body is fully closed, and a duty for the solenoid valve is set, when the full-close switch is switched from the "ON" position to an "OFF" position, to stationarily hold the duty as it is without causing variation in an adjusted value for the solenoid valve at a time when a switching operation of the full-close switch is carried out.

According to this aspect, at a time of switching the full-close switch from the ON position to the OFF position, the rapid change of the engine revolution number can be prevented at time of a minute or fine open/close control of the throttle valve of the engine.

In preferred embodiments of this aspect, a map gradient is offset so as to leave the gradient as it is and pass through a duty value as held. The adjusted value at a time when the full-close switch is switched from the "ON" position to an "OFF" position is reflected in the map in a case where the full-close switch is kept in the "OFF" position. The offsetting is conducted by determining a revolution number of the engine and the adjusted value at a time when the full-close switch is switched from the "ON" position to an "OFF" position, in accordance with differences from similar lattice points in a basic map. Upper and lower limits are provided for an amount of the offsetting.

According to these preferred embodiments, the map is moved itself in accordance with the air amount, and the engine revolution is performed in a normal change or variation in increasing or decreasing mode, thus ensuring a normal and steady operation.

Furthermore, the behavior of the engine revolution number due to the open/close operation of the throttle valve after the switching to the "OFF" position of the full-close switch valve can be made substantially equal to that in the normal operation.

Still furthermore, the adjusted value at a time when the full-close switch is switched from the "ON" position to the "OFF" position in accordance with differences from similar lattice points in a basic map, so that the possibility of occurrence of engine stall will be effectively eliminated.

In addition, even if the switching from the "ON" position to the "OFF" position of the full-close switch be made at a time of just after the engine starting or during the dashpot operation, the possibility of occurrence of rapid lowering of the engine revolution or lowering thereof will be effectively eliminated.

In a still further aspect, there is also provided a control method of an engine having an intake device provided with a throttle body and a solenoid valve to control an amount of intake air on a basis of a duty control, wherein a full-close switch is kept in an "ON" position when a throttle valve mounted to the throttle body is fully closed, and a duty for the solenoid valve is set, when the full-close switch is switched from the "ON" position to an "OFF" position, to stationarily hold the duty as it is without causing variation in an adjusted value for the solenoid valve at a time when a switching operation of the full-close switch is carried out.

In the above aspects, the engine may preferably be an engine for an outboard in which a crankshaft is placed so as to extend vertically in an installed state.

The nature and further characteristic features of the present invention will be made more clear from the following descriptions made with reference to the accompanying drawings.

DESCRIPTION OF THE PREFERRED EMBODIMENTS

Now, an embodiment of the present invention will be described hereunder with reference to the accompanying drawings.

Figure 1:
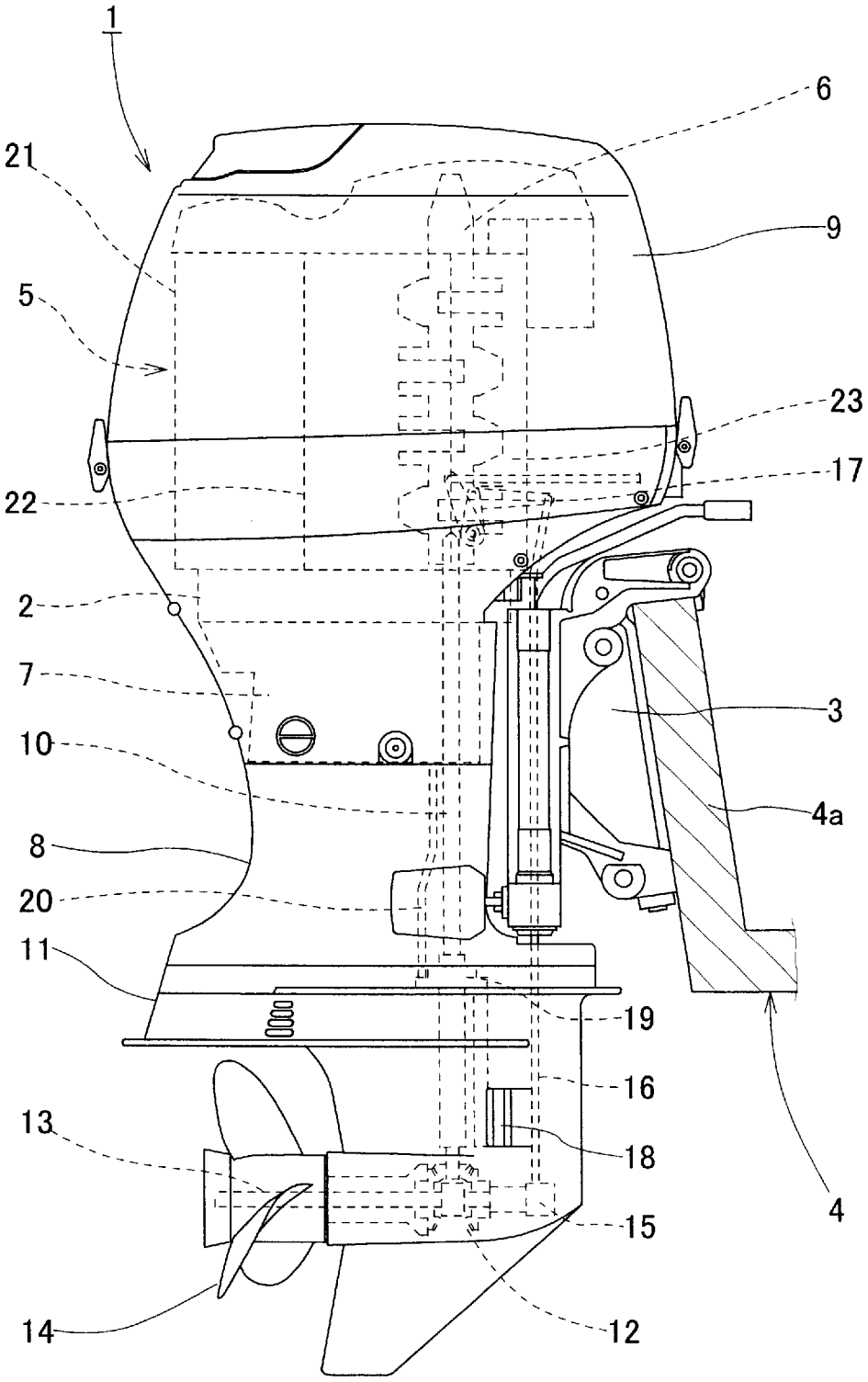
FIG. 1 is a right-hand side view of an outboard motor including an embodiment of a control system of the engine of the present invention.

FIG. 1 is a right-hand side view of an outboard motor to which the present invention is applied. The outboard motor 1 having an engine holder 2 is mounted on a transom 4*a* of a hull 4 through a bracket 3 secured to the engine holder 2.

The engine holder 2 has an exhaust passage and a discharge-water (drain) passage, both not shown, described later, which are formed in the engine holder 2. An engine (or engine unit) 5 is mounted to the upper portion of the engine holder 2. The engine 5 is placed vertically so that a crankshaft 6 extends therein substantially vertically. A drive shaft housing 8 is disposed on the lower portion of the engine holder 2 through an oil pan 7 having an exhaust passage and a discharge-water passage, both not shown, described later, which are formed in the oil pan 8. The engine 5 is surrounded by an engine cover 9.

A drive shaft, which is connected to the lower end of the crankshaft 6, is placed in the oil pan 7 and the drive shaft housing 8, and extends downward so as to drive a propeller 14 through a bevel gear 12 and a propeller shaft 13, which are placed in a gear case 11 provided on the lower portion of the drive shaft housing 8.

The gear case 11 is provided therein with a shift device 15 for shifting a rotational direction of the propeller shaft 13 and the propeller 14 to forward, reverse or neutral position through a remote control. A shift rod 16 extends upward from the shift device 15 so as to be connected to a link mechanism 17 provided in the engine cover 9.

The gear case 11 has a water intake 18 formed on the side surface of the gear case 11. Seawater or fresh water, which is introduced from the water intake 18 so as to serve as cooling water, is pumped to the engine 5 through a cooling water pipe 20. The cooling water supplied into the engine 5 cools the structural components of the engine 5 and is then discharged outward together with the exhaust gas from the engine 5.

Figure 2:
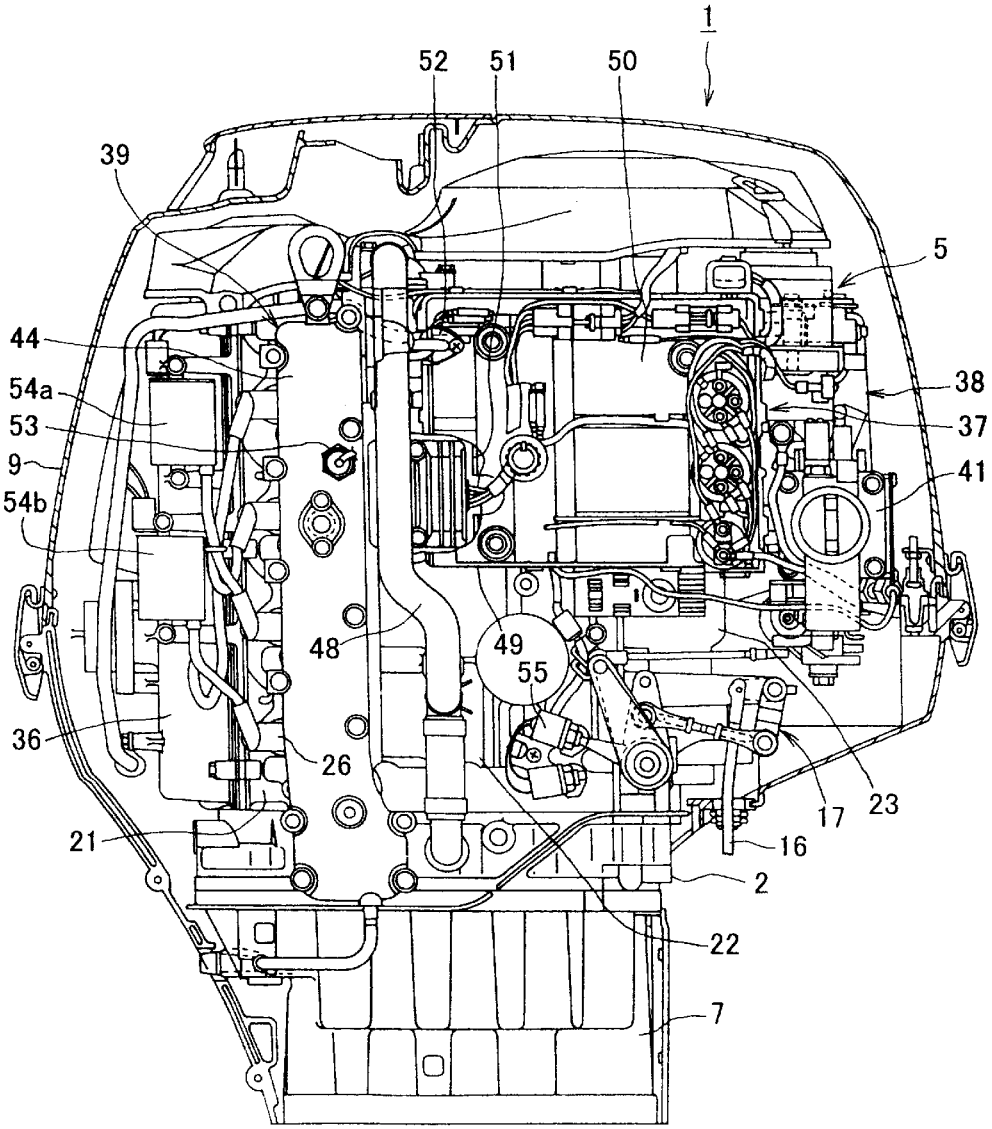
FIG. 2 is an enlarged right-hand side view of engine parts of the outboard motor as shown in FIG. 1.
Figure 3:
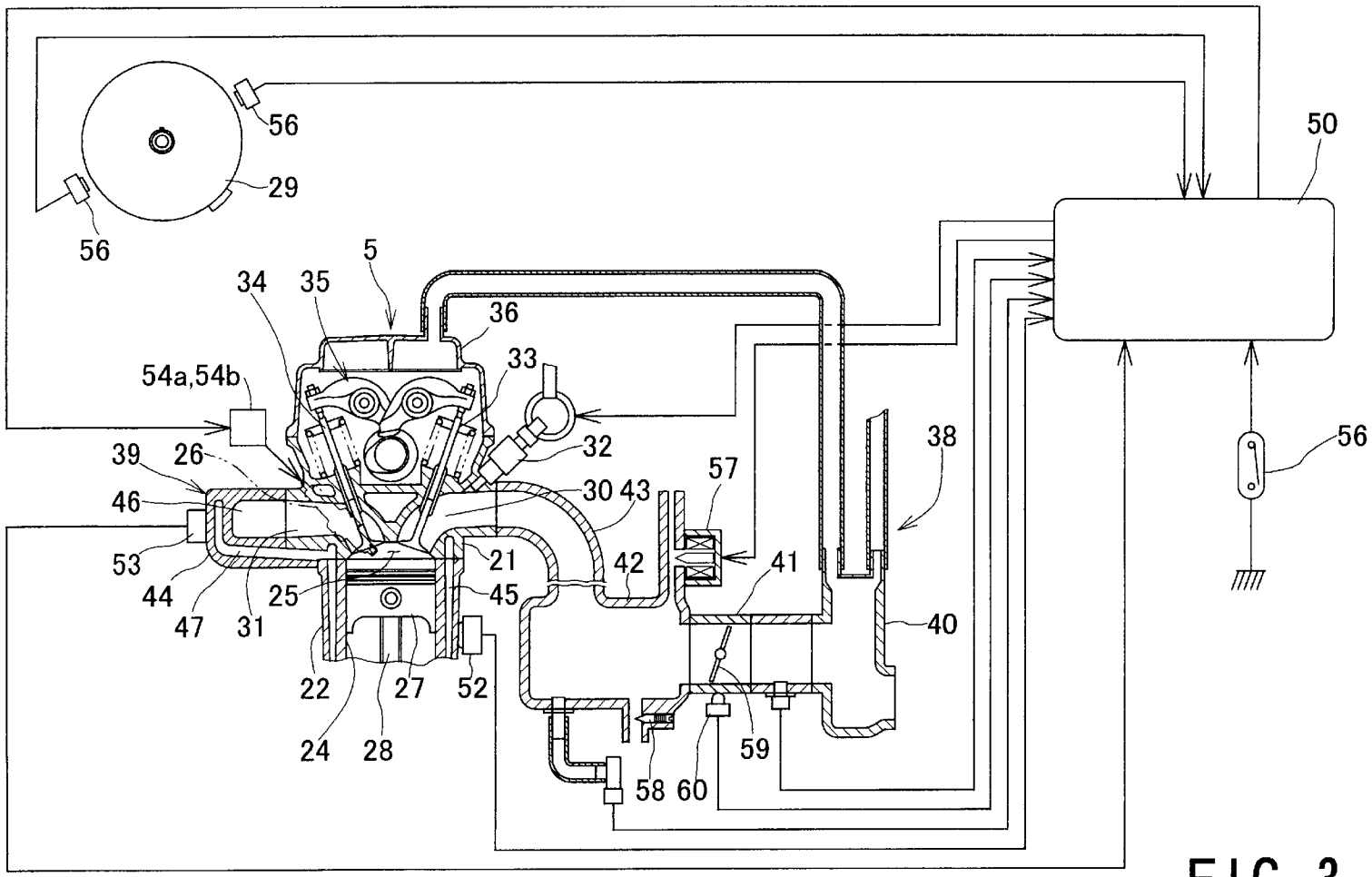
FIG. 3 is a system diagram of the engine of the outboard motor as shown in FIG. 1.

FIG. 2 is an enlarged right-hand side view of the engine parts 5 as shown in FIG. 1 and FIG. 3 is a system view of the engine 5. As shown in FIGS. 1 to 3, the engine 5 is for example a water-cooled four-stroke-cycle four-cylinder engine, in which a cylinder head 21, a cylinder block 22 and a crankcase 23 are disposed and arranged in the transverse direction.

The cylinder block 22 of the engine has cylinders 24 formed therein. The cylinder head 21 has combustion chambers 25, which are formed so as to align with the cylinders 24, respectively. Ignition plugs 26 are connected to the cylinder head 21 from the outside. Pistons 27 are slidably inserted into the cylinders 24, respectively. The pistons 27 and the crankshaft 6 are connected by means of connecting rods 28, although such a structure is not described in detail. A reciprocating motion of the piston 27 is converted into a rotational motion of the crankshaft 6. In addition, a flywheel magneto 29 is secured to the upper end of the crankshaft 6 so as to be rotated together with it, though such a structure is not described in detail.

The cylinder head 21 has intake ports 30 and exhaust ports 31 formed therein, which communicate with the combustion chambers 25, respectively. A fuel injector 32, which injects fuel into the intake port 30, is fitted to the cylinder head 21 from the outside. A valve gear 35 including an intake valve 33 and an exhaust valve 34 for opening or closing the above-mentioned ports 30, 31, is also mounted in the cylinder head 21. A cylinder head cover 36 covers the above-mentioned valve gear 35.

Electrical equipment 37, an intake device 38 and an exhaust device 39 are disposed on the periphery of the engine 5. The intake device 38 is mainly composed of a silencer 40, a throttle body 41, a surge tank 42 and an intake manifold 43 having a plurality of intake pipes, which extend from the surge tank 42 to the respective cylinders. These components are gathered up on one side of the cylinder block 22, though such an arrangement is not described in detail.

The exhaust device 39 is disposed on the side opposite to the intake device 38. The electrical equipment 37 is also gathered up on the same side as the exhaust device 39. The exhaust device 39 has an exhaust manifold, which is supported by a side surface of the cylinder head 21 and a side surface of the engine holder 2.

A water jacket 45 is formed on the periphery of the cylinders 24 of the cylinder block 22 and the periphery of the combustion chambers 25 of the cylinder head 21. The exhaust manifold 44 has an exhaust passage 46, which is formed therein and connects the exhaust ports 31 of the cylinder block 22 and the not-shown exhaust passages formed each other on the engine holder 2 and the oil pan 7. A water jacket 47 is also formed on the periphery of the exhaust passage 46.

A cooling water exit, not shown, of the water jacket 45, which is formed on the cylinder block 22, is placed above the cylinder block 22. An exhaust hose 48, which is connected to the above-mentioned cooling water exit, extends downward. The downstream end of the hose 48 is connected to the not-shown exhaust passages for the cooling water, which are formed in the engine holder 2 and the oil pan 7 so as to discharge the cooling water into the drive shaft housing 8.

An electrical equipment holder 49 is disposed on the side surface of the engine 5 and the front side of the exhaust manifold 44. A control unit 50 for controlling the engine 5 is placed in the electrical equipment holder 49. A rectifier/regulator 51 is disposed between the exhaust manifold 44 and the electrical equipment holder 49.

A cylinder-temperature sensor 52 for detecting the temperature of the cylinder is provided on the side surface of the cylinder block 22, which is placed for example above the rectifier/regulator 51. In addition, a manifold-temperature sensor 53 for detecting the temperature of the exhaust manifold 44 is also provided on the side surface of the exhaust manifold 44.

In addition, an ignition coil 54*a* for the second and third cylinders from the upper side is provided on the upper portion of the side surface of the cylinder head cover 36, as viewed in an engine installed state. An ignition coil 54*b* for the first and fourth cylinders from the upper side is provided on the lower portion of the side surface of the cylinder head cover 36.

A neutral switch 55, for detecting whether or not the shifted position is a neutral position, is arranged in the vicinity of the link mechanism 17 of the shift device 15.

A crank angle sensor 56 for detecting a rotational angle of the crankshaft 6 is provided in the vicinity of the outer peripheral surface of the flywheel magneto 29, as shown in FIG. 3. An IAC (idle-air-control) solenoid valve 57 for adjusting an amount of air in an idling state is provided in the surge tank 42 for air adjustment and an air-bypass screw 58 is also provided therein. The throttle body 41 is provided with a full-close switch 60, which is kept in the "ON" position when the throttle valve 59 disposed in the inside of the throttle body 41 is fully closed.

The IAC solenoid valve may perform an engine starting operation control, a revolution number feedback control at the full-close time of the throttle valve 59 and a dashpot control. The solenoid valve 57 also serves to change the intake air amount of the engine independent of the operation of the throttle valve 59.

Figure 4:
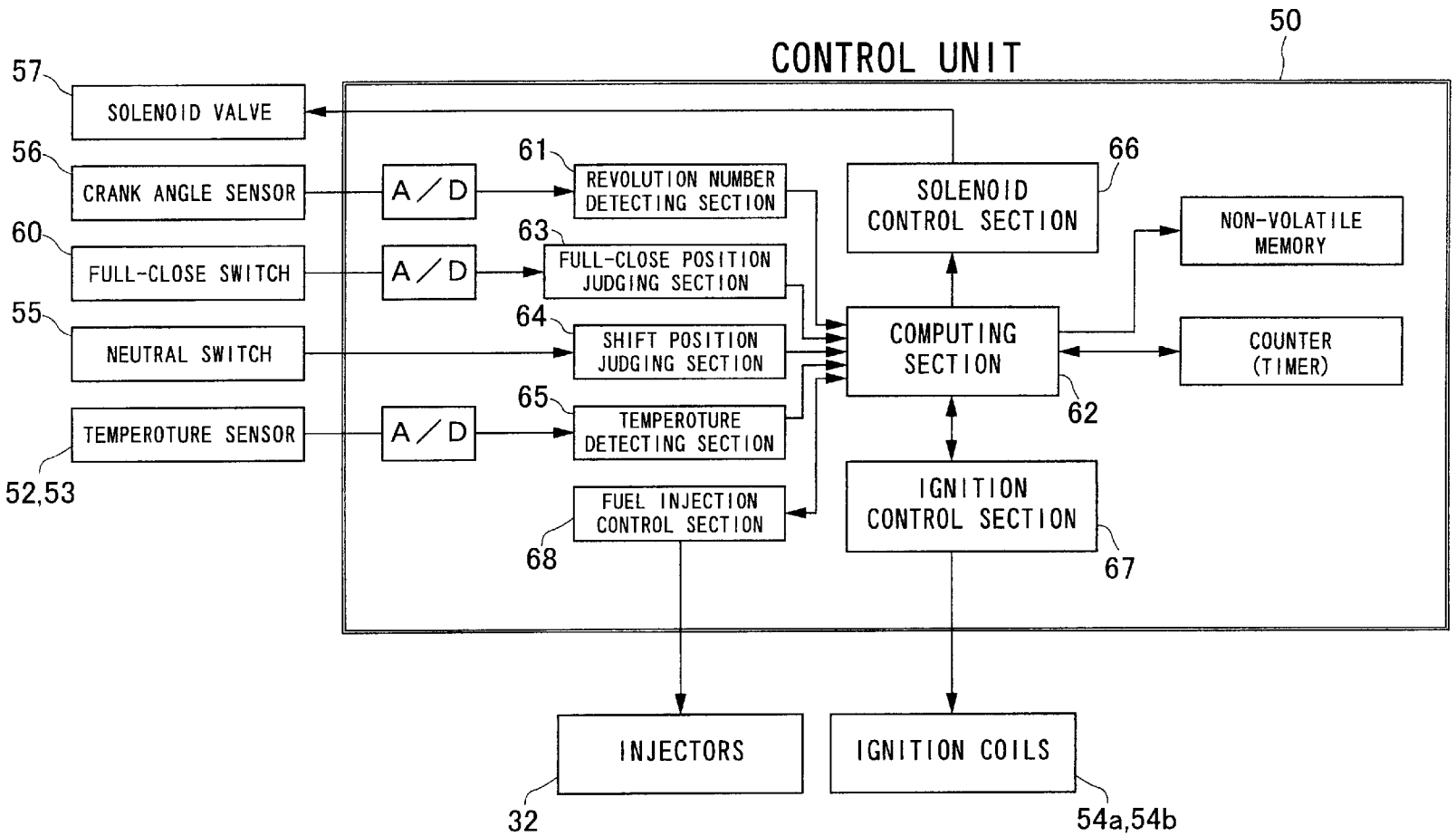
FIG. 4 is a block diagram of the engine unit as shown in FIG. 3.

FIG. 4 is a block diagram of the engine system as shown in FIG. 3. Information obtained by the sensors and switches is transmitted to the control unit 50, as shown in FIG. 4. More specifically, the rotational angle of the crankshaft 6, which is obtained from the crank angle sensor 56, is A/D (analog/digital)-converted and then transmitted to a revolution number detecting unit 61. The data of the revolution number of the engine, which is obtained by the revolution number detecting unit 61, are then transmitted to a computing unit 62.

Positional information of the throttle valve 59 in the throttle body 41, which is obtained from the full-close switch 60 is A/D-converted and then transmitted to a full closing position determination section 63. The positional data of the throttle valve 59, which is obtained by the full closing position determination section 63, are then transmitted to the computing unit 62.

Shift-positional information of the shift device 15, which is obtained from the neutral switch 55, is transmitted to a shift position determination section 64. The positional data of the shift device 15, which is obtained by the shift position determination section 64, are then transmitted to the computing unit 62.

Temperature information of the cylinder 24 and the exhaust manifold 44, which is obtained from the cylinder-temperature sensor 52 and the manifold-temperature sensor 53, is transmitted to a temperature-detecting unit 65. The temperature data of the cylinder 24 and the exhaust manifold 44, which is obtained by the temperature-detecting unit 65, are then transmitted to the computing unit 62.

The information obtained from the sensors and switches are processed by means of the computing unit 62. Appropriate control signals are transmitted to a solenoid control section 66, an ignition control section 67 and a fuel injection control section 68 to control the IAC solenoid valve 57 for adjusting an amount of air in the idling state, the fuel injector 32 for injecting fuel into the intake port 30 and the ignition coils 54*a*, 54*b* for igniting the ignition plugs 26.

The solenoid valve 57 is provided on the intake device 38 of the engine 5 to control an amount of intake air on the basis of a duty control with the use of the control unit 50, in order to make idling of the engine 5 stable and improve starting performance. It is necessary to initialize the amount of intake air periodically to improve the above-mentioned performance to more than a certain predetermined level.

Figure 5:
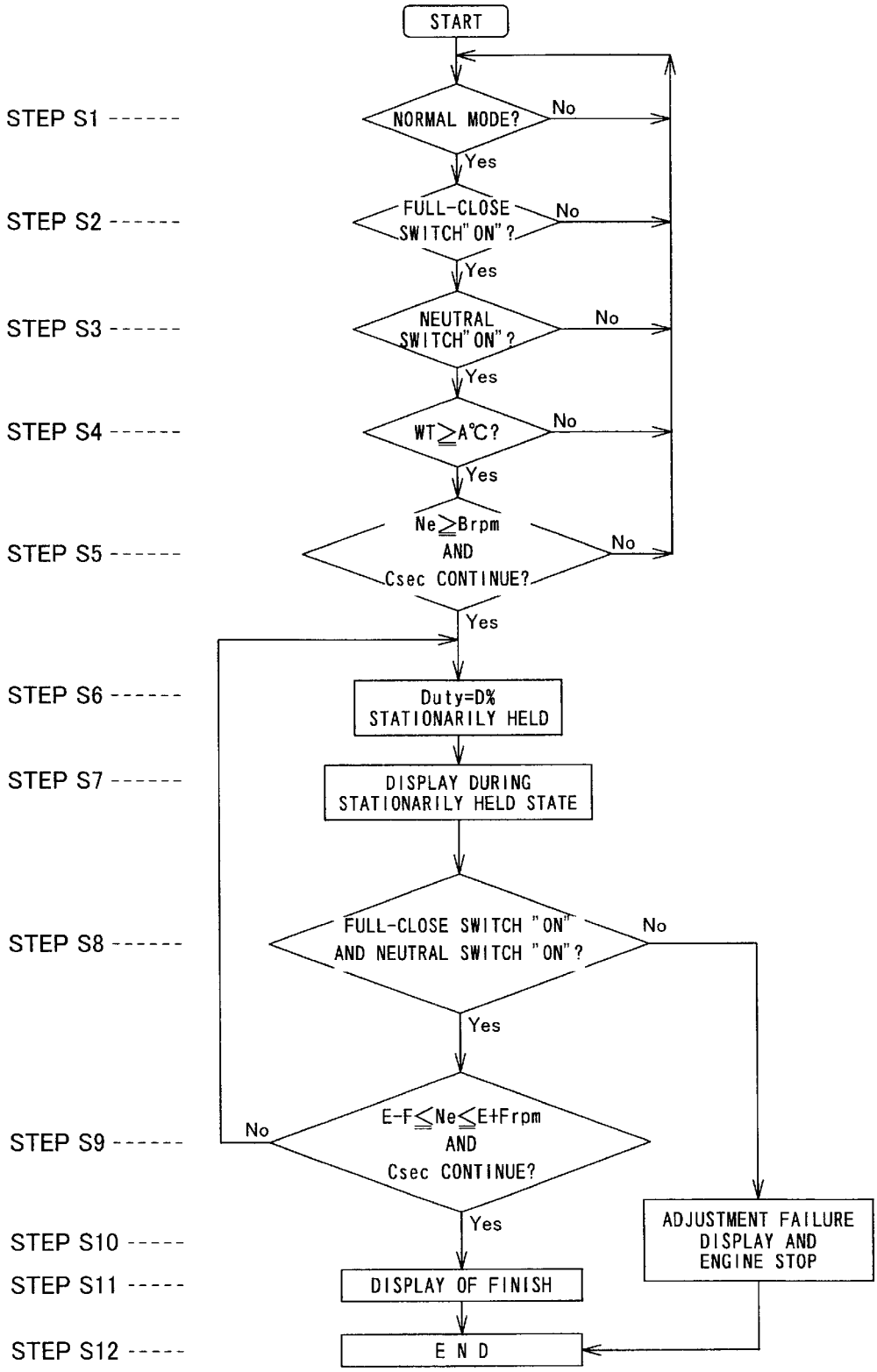
FIG. 5 is a flow chart illustrating a flow of engine control according to one control aspect of the present invention.
Figure 6A:
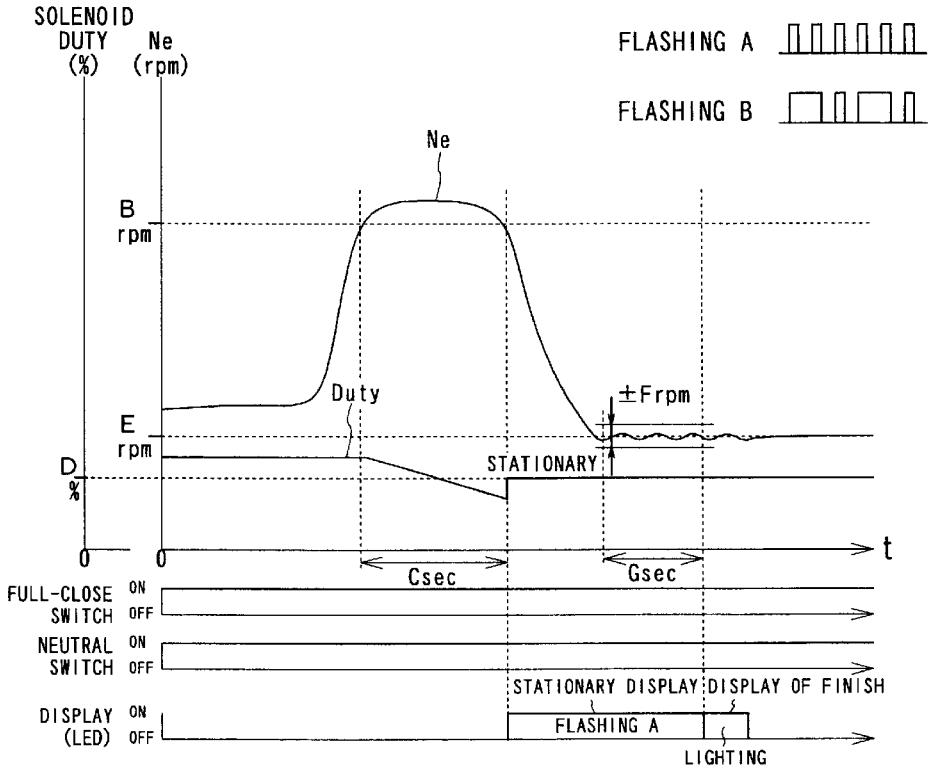
FIGS. 6A and 6B are timing charts of the engine control.
Figure 6B:
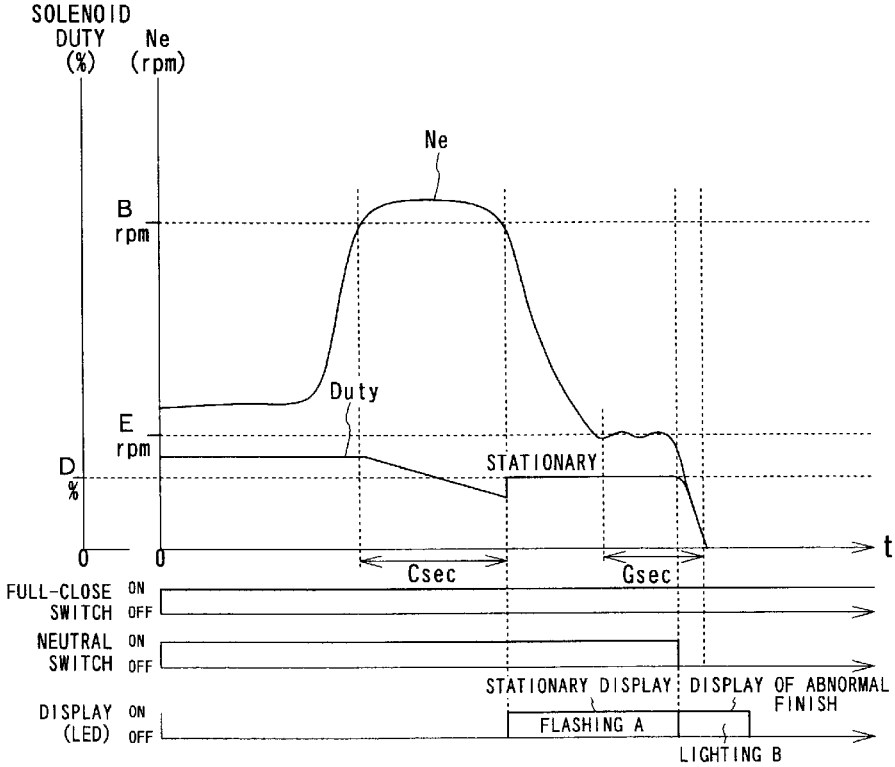

FIG. 5 is a flow chart illustrating a control method for initializing an amount of air (initial setting method) according to the present invention. FIGS. 6A and 6B are timing charts. The initializing method is made on the assumption that the solenoid valve 57 is subjected to the duty control.

As shown in FIGS. 5 and 6A, after starting the engine 5, it is judged whether or not the control of the engine 5 and the solenoid valve 57 by means of the control unit 50 is carried out in a normal mode (Step S1 in FIG. 5), it is then discriminated or judged whether or not the throttle valve 59 in the throttle body 41 is in a fully closed state, i.e., whether the full-close switch 60 is kept in the "ON" position (Step S2) and it is then discriminated or judged whether or not the shift position of the shift device 15 is in a neutral state, i.e, whether the neutral switch 55 is kept in the "ON" position (Step S3).

Values from the temperature sensors 52, 53 of the cylinder 24 and the exhaust manifold 44 are always monitored by means of the control unit 50 as described above. Consequently, it is judged whether or not the values (WT) from the temperature sensors 52, 53 are equal to or larger than the prescribed temperature (A° C.) (WT≧A° C.), i.e., whether the engine 5 is kept in the warming up state (Step S4).

An operator turns the air-bypass screw 58 in a loosening direction for example with the use of a tool such as a screwdriver in a stable warming up state of the engine 5, to set the revolution number of the engine 5 to at least set revolution number (Brpm). Such an operation is to cause the control unit 50 to recognize the evidently different state from the normal state (i.e., the steady state in which the revolution number of the engine 5 increases even when the throttle valve 59 is fully closed and the full-close switch 60 is kept in the "ON" position).

In such a state, it is discriminated or judged whether or not the revolution number (Ne) of the engine 5 is equal to or larger than the above-mentioned set revolution number (Brpm) (Ne≧Brpm) and the engine 5 continuously operates at such a revolution number for at least set period of time (Csec) (Step S5).

When all the conditions of Steps S1 to S5 are satisfied, a duty for controlling the solenoid valve 57 is held stationarily at a necessary value D % (Step S6). During the period of time of stationarily holding the duty, an operator recognizes, by means of display device such as LED (light emitting diode) or audio response device such as buzzer, the fact that the duty is held stationarily (Step S7). FIG. 6A includes a display example of flush "A" of the LED with a constant cycle, which indicates the fact that the duty is now being held stationarily.

After the completion of the operation for stationarily holding the duty, the operator turns the air-bypass screw 58 in a tightening direction to reduce the revolution number of engine 5 to the target revolution number (E). It is checked during the above-mentioned operation whether or not the throttle valve 59 is still fully closed (i.e. the full-close switch 60 is kept in the "ON" position) and the shift position of the shift device 15 is in a neutral state (i.e., the neutral switch 55 is kept in the "ON" position) (Step S8 in FIG. 5).

It is then judged whether or not the revolution number (Ne) of the engine 5 is within the target range (E±Frpm) of the revolution number (E), which includes an error (F), (E−F≦E+Frpm), and the engine 5 continuously operates for at least the set period of time (Csec) (Step S9).

On the contrary, when the shifting operation is for example carried out for some reason during the holding operation of the duty and the neutral switch 55 is kept in the "OFF" position, it is recognized for the operator, by means of display device such as LED or audio response device such as buzzer, that the adjustment results in fail, as shown in FIG. 6B (Step S10), and the operation of the engine 5 is immediately stopped. FIG. 6A also includes a display example of flush "B" of the LED with an inconstant cycle, which indicates the fact that the adjustment results in fail.

When there are satisfied both conditions of(i) the revolution number (Ne) of the engine 5 being within the target range (E±Frpm) of the revolution number (E), which includes the error (F) and (ii) the engine 5 continuously operating for at least the set period of time (Csec) the LED flushes for example to indicate the finish of the operation and then such an indication ceases (Step S11). The holding operation of the duty for the solenoid valve 57 is also finished to complete the duty adjustment (Step S12).

In the above-described embodiment, tools necessary for initialization of an amount of air are only the screwdriver for turning the air-bypass screw 58 and a tachometer, not shown, for measuring the revolution number of the engine 5. It is therefore possible for any person having a knowledge of the adjusting method of easily initializing the amount of air.

The setting operation is carried out after recognition of the warming up condition of the engine 5 utilizing the temperature sensors 52, 53. It is therefore possible to minimally reduce the influence of friction due to the temperature of the engine 5 and make a set range of amount of air narrow, thus minimally reducing the adjustment variation.

In the conventional case, when any exclusive tool has not been available, there has been adopted measures to make an indirect duty adjustment by, for example, closing the intake port of the solenoid valve with a finger and turning, in such a state, the air bypass screw to adjust a bypass flow rate so as to adjust the revolution number to a level, which is lower than the target revolution number. In the present invention, a direct adjustment of the duty of the solenoid valve 57 can be performed in an easy and accurate manner.

When an adjustment of the duty of the solenoid valve 57 is made, the revolution number of the engine 5 is increased with the use of the air-bypass screw 58. Accordingly, there is no apprehension of stall of the engine 5 during the operation, thus easily making an adjustment.

In addition, the duty is held stationarily after the engine 5 operates at the set revolution number or more of the engine 5 for at least set period of time, and the duty adjustment is automatically finished after the engine 5 stably operates at the target range of the revolution number, which includes the error, for at least the set period of time. It is therefore possible to realize an easy adjustment and prevent the amount of air from being erroneously fixed or stationarily held or prevent the subjectivity of an operator from being incorporated into the working.

Furthermore, information of the duty-holding state, fail in the adjusting operation and the completion of the adjusting operation is transmitted to the operator by means of display device such as LED or audio response device such as buzzer. It is therefore possible for the operator to recognize any time the operating condition, thus achieving an easy and accurate adjustment.

The condition of the throttle valve 59 and the shift position of the shift device 15 are always checked during the operation, and in the embodiment of the present invention, the adjusting operation is carried out, provided that a boat is at rest. In addition, the engine 5 is designed to stop, if the boat starts moving for some reason. Safety for the operator is therefore secured in this manner.

The above-described embodiment includes the example in which the method of the present invention for initializing the amount of air is applied to the duty control of the solenoid valve 57. It is also possible to apply the present invention to adjustment of amount of air for a rotary valve or a step motor.

In the above-described embodiment, the operation for increasing the revolution number of the engine 5 in a case where the throttle valve 59 is completely closed, in order to cause the control unit 50 to recognize the evidently different state from the normal state at a time of stationarily holding the duty at a necessary value. Alternatively, the state may be recognized by the control unit 50 by carrying out an operation of reducing a voltage level of a terminal in a harness of the electrical equipment 37 to the GND level, or impressing current at 12 volts to the terminal, though being not described in detail.

Measures to cause the control unit 50 to recognize the evidently different state from the normal state may include operations of (i) starting the engine 5 after an engine-starting key switch is continuously turned five times to the start position in a state where the shift position of the shift device 15 is set to the forward position, (ii) repeatedly turning the engine-starting key switch to the starting position in a state where an emergency switch is kept in the "ON" position, and (iii) starting the engine 5 while pushing a reset switch, though being not described in detail. These measures are not limited only to the above-described operations.

Next, as mentioned before, the air amount controlling according to another aspect of the present invention will be described hereunder.

A matching method is applied to the initialization of the engine 5 so as not to cause any change in the duty for the solenoid valve 57, namely any rotational variation of the engine 5 in a case where the full-close switch 60 is kept either in the "ON" position or in the "OFF" position (i.e., a substantially closed state by which almost no change in an amount of air passing through the passage occurs). However, an improper servicing and a secular deterioration of the air-bypass screw 58, deterioration of lubricant oil and variation in friction provide deviation in the matching, causing inconvenience of faster or later deceleration under a dashpot control and of a sudden rise or drop of the revolution number of the engine 5 in the case where the throttle valve 59 is slightly opened.

Such inconvenience will be also solved according to the controlling of the present invention with reference to FIGS. 7 to 10.

Figure 7:
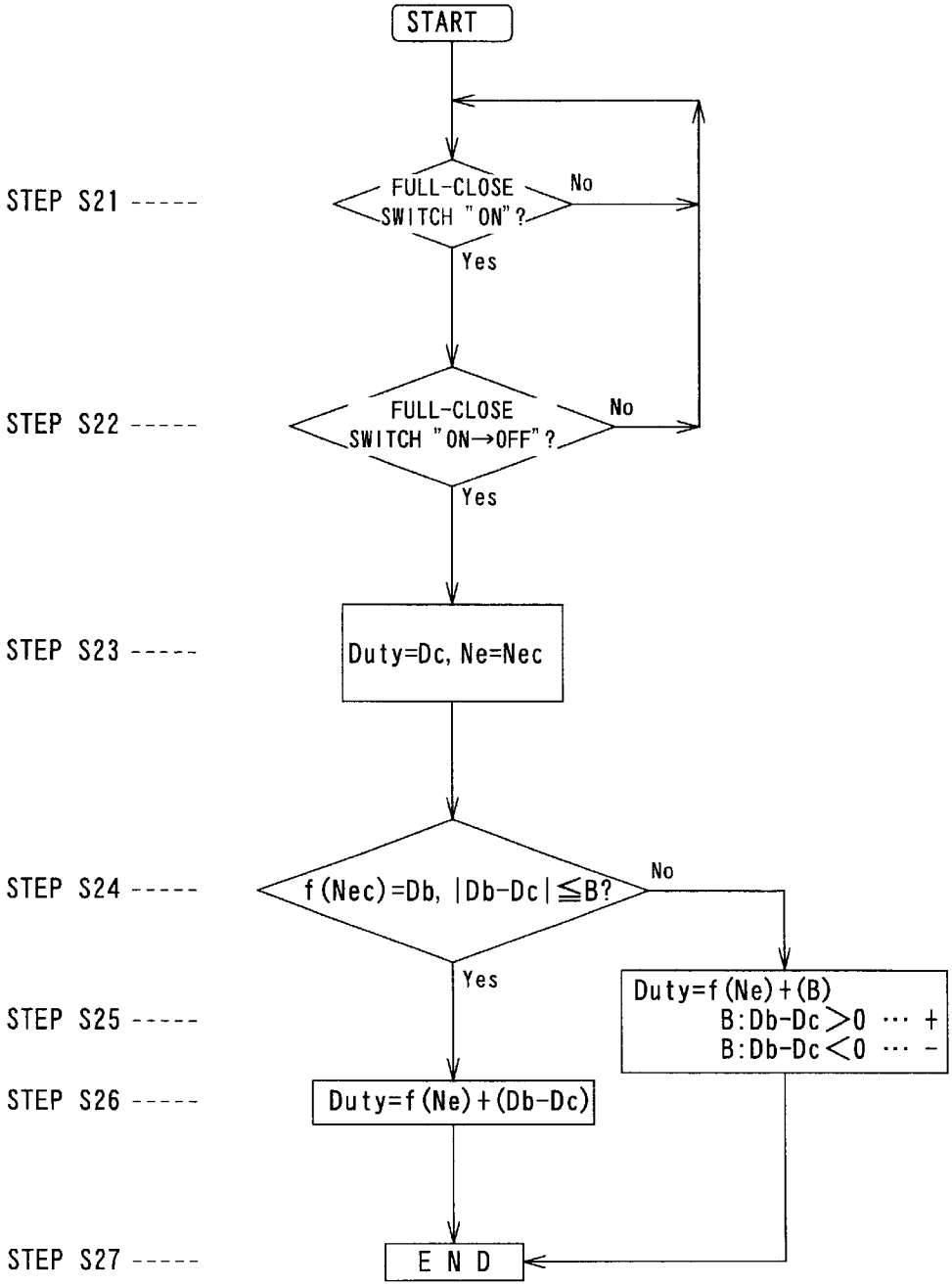
FIG. 7 is a flow chart illustrating a flow of engine control according to another control aspect of the present invention.
Figures 8, 9, 10:
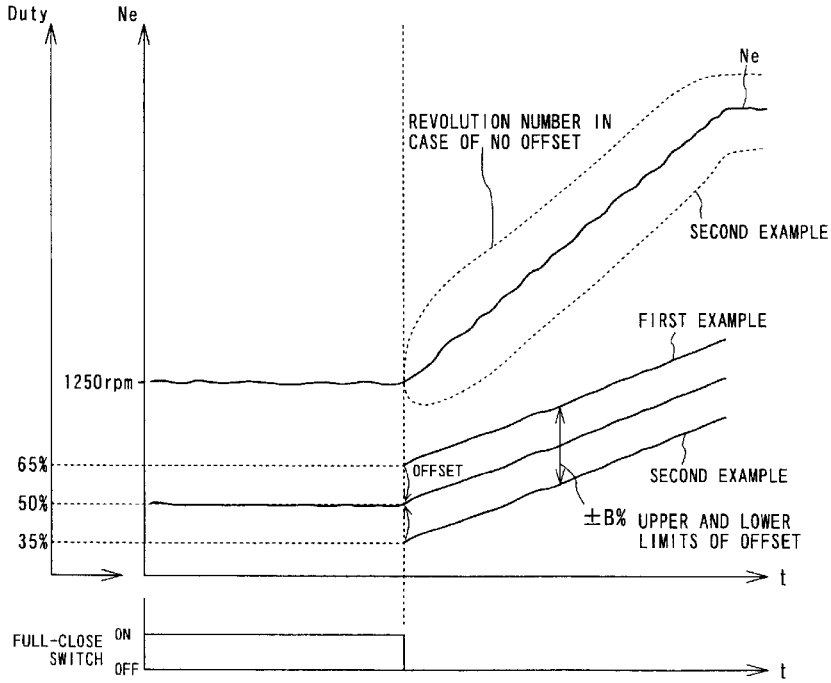
FIG. 8 is a table of a first example of a basic map at an OFF time of a full-close switch.
FIG. 9 is a table of a second example of a basic map at an OFF time of a full-close switch.
FIG. 10 is a timing chart representing the control according to the another control aspect of the present invention.

FIG. 7 is a flowchart illustrating flow of control, which is conducted by the control system or unit for controlling an amount of air. FIGS. 8 and 9 illustrate one (first) example of the basic map in a case where the full-close switch 60 is kept in the "OFF" position and another (second) example of the basic map in a case where the full-close switch 60 is kept in the "OFF" position, respectively. FIG. 10 is a timing chart for the control.

First, it is discriminated or judged whether or not the full-close switch 60 is kept in the "ON" position, i.e., the throttle valve 59 is in a fully closed state (Step S21 in FIG.

7). When the full-close switch 60 is kept in the "ON" position, it is then discriminated or judged whether or not the full-close switch 60 is switched from the "ON" position to the "OFF" position (Step S22).

When the full-close switch 60 is switched from the "ON" position to the "OFF" position, the duty (D %) for the solenoid valve 57 is stationarily held and the revolution number at the time when the switching is carried out is set as "Necrpm" (Step S23).

The duty (Dc %) as actually shifted is compared with the duty (DB %) in the basic map, which is set in "Necrpm(f (Nec)) of the map in the case where the full-close switch 60 is kept in the "OFF" position and difference between them is obtained. It is judged whether or not an absolute value of the difference (|Db−Dc|) exists between the upper and lower limits (B %) of the offset duty (Step S24).

When the absolute value exceeds the upper limit (B %) of the offset duty, the offsetting of the map of the duty is restricted within the range between the upper and lower limits (±B %) (Step S25).

When the absolute value is less than the lower limit (B %) of the offset duty, the whole map is offset by the difference (Duty=f(Ne)+(Db−Dc)) (Step S26).

This controlling is continuously conducted, while maintaining the offset state of the map in the case where the full-close switch 60 is kept in the "OFF" position, until the full-close switch 60 turns to the "ON" position.

If the duty (Db %) in the basic map, corresponding to 1250 rpm (=Nec) of the offset standard point of the map (the "ON" position is switched to the "OFF" position) is 65% and the duty (Dc %) as actually shifted is 50%, the offset value is 15% in the case where the upper limit (B %) for the offsetting is 20%, as shown in FIG. 8. The offset value is 10% in the case where the upper limit (B %) for the offsetting is 10%.

In the above first and second examples, the revolution number of the offset standard point of the map (the "ON" position is switched to the "OFF" position) is set to 1250 rpm. Any value depending on the type of engine may be set.

The duty (D %) for the solenoid valve is set, when the full-close switch 60 is switched from the "ON" position to the "OFF" position, to stationarily hold the duty as it is, and the map gradient is offset so as to leave the gradient as it is and pass through the duty value as held. Accordingly, there causes no variation in the adjusted value for the solenoid valve 57 at a time when the switching operation of the full-close switch 60 is carried out. It is therefore possible to prevent a rapid change in the revolution number of the engine at a time of carrying out the dedicate opening or closing operation of the throttle valve 59.

The map gradient is offset so as to leave the gradient as it is. Consequently, the revolution number of the engine increases or decreases in the same manner as the normal or steady case, thus leading to no change in operability.

The adjusted value at a time when the full-close switch 60 switches from the "ON" position to the "OFF" position is reflected in the map in the case where the full-close switch 60 is kept in the "OFF" position. It is therefore possible to make the behavior of the revolution number of the engine by the opening or closing operation of the throttle valve 59, which is carried out after the full-close switch 60 has been switched to the "OFF" position, same as the behavior in the normal state.

In addition, the offsetting is conducted by the method for determining the revolution number of the engine and the adjusted value at a time when the full-close switch 60 is switched from the "ON" position to the "OFF" position, based on the differences from the similar lattice points in the basic map. Consequently, the offset point is always larger than the adjusted value of the amount of air when the revolution number is fed back. There is therefore an extremely small possibility of occurrence of stall of the engine.

The setting of the upper and lower limits to the amount of the offsetting can eliminate the offsetting which is conducted by an unnecessarily large amount of offset value, even when the switching operation of the full-close switch 60 from the "ON" position to the "OFF" position is carried out immediately after the start of the engine 5. It is therefore possible to prevent the revolution number of the engine from rapidly reducing or failing to be reduced.

Further, in the aspects of the above-described embodiments, the present invention is applied to the engine 5 for the outboard 1. The present invention may, however, be applied to any type of engine for a vehicle such as an automobile and a motorcycle so long as the control of the amount of intake air is conducted with the use of the solenoid valve of the characters mentioned above.

What is claimed is:

1. A control system of an engine, in which an intake device is provided with a solenoid valve and an amount of intake air is controlled on a basis of a duty control by means of a control unit, wherein the control unit includes means for recognizing a state which is evidently different from a normal state to thereby stationarily hold a duty of the solenoid valve at a necessary set value and at a recognition of the control unit being of a state different from the normal state, the duty of the solenoid valve is fixed to a necessary value to thereby perform an initial setting of the intake air amount.

2. A control system of an engine according to claim 1, wherein, at the time of the initial setting of the intake air amount, said evidently different state from the normal state is caused by carrying out an operation for increasing a revolution number of the engine in a fully closed state of a throttle valve so as to be recognized by the control unit.

3. A control system of an engine according to claim 2, wherein a time elapsed is set for increase in the revolution number of the engine.

4. A control system of an engine according to claim 1, wherein at the time of the initial setting of the intake air amount, said evidently different state from the normal state is caused by carrying out an operation for setting a voltage level of a terminal in a harness to a level, which is different from a normal voltage level so at to be recognized by the control unit.

5. A control system of an engine according to claim 1, wherein at the time of the initial setting of the intake air amount, said evidently different state from the normal state is caused by carrying out a switching operation of a specific switch so as to be recognized by the control unit.

6. A control system of an engine according to claim 1, wherein said duty is set to be stationarily held after recognition of a warming up state of the engine.

7. A control system of an engine according to claim 1, wherein said duty is set to be stationarily held after recognition that a shift device takes a neutral state in a shift position thereof.

8. A control system of an engine according to claim 1, wherein at the time of the initial setting of the intake air amount, an information that said duty is stationarily held is set to be transmitted to an operator by means of at least either one of display device and audio response device.

9. A control system of an engine according to claim 1, an adjustment of said duty is automatically stopped after the engine is stably and continuously operated for a set period of time within a range of an error of a target revolution number.

10. A control system of an engine according to claim 1, wherein at the time of the initial setting of the intake air amount an information on completion of an operation for stationarily holding the duty is set to be transmitted to an operator by means of at least either one of display device and audio response device.

11. A control system of an engine according to claim 1, wherein said engine is set to be stopped immediately after the operation for stationarily holding the duty is failed.

12. A control method of an engine having an intake device provided with a solenoid valve and a control unit, comprising the steps of:

controlling an amount of intake air on a basis of a duty control by the control unit, holding stationary a duty of the solenoid valve to a necessary set value through recognition, to the control unit, of a state which is evidently different from a normal state to thereby stationarily hold a duty at a necessary set value, and fixing, at a recognition of the control unit being of a state different from the normal state, the duty of the solenoid valve to a necessary value in order to perform an initial setting of the intake air amount.

13. A control system of an engine having an intake device provided with a throttle body and a solenoid valve to control an amount of intake air on a basis of a duty control, wherein a full-close switch is provided, which is kept in an "ON" position when a throttle valve mounted to the throttle body is fully closed, and a duty for said solenoid valve is set, when said full-close switch is switched from the "ON" position to an "OFF" position, to stationarily hold the duty as it is without causing variation in an adjusted value for the solenoid valve at a time when a switching operation of the full-close switch is carried out.

14. A control system of an engine according to claim 13, wherein a map gradient is offset so as to leave the gradient as it is and pass through a duty value as held.

15. A control system of an engine according to claim 14, wherein said adjusted value at a time when the full-close switch is switched from the "ON" position to an "OFF" position is reflected in the map in a case where the full-close switch is kept in the "OFF" position.

16. A control system of an engine according to claim 14, wherein the map gradient offset is calculated by means of determining a revolution number of the engine and the adjusted value at a time when the full-close switch is switched from the "ON" position to an "OFF" position, in accordance with differences from similar lattice points in a basic map.

17. A control system of an engine according to claim 16, wherein upper and lower limits are provided for an amount of the map gradient offset and in a case where the calculated offsetting exceeds the upper and lower limits, an offsetting amount is made as the upper and lower limits.

18. A control system of an engine according to claim 13, wherein the engine is an engine for an outboard in which a crankshaft is placed so as to extend vertically in an installed state.

19. A control method of an engine having an intake device provided with a throttle body and a solenoid valve to control an amount of intake air on a basis of a duty control, comprising of the steps:

keeping a full-close switch in an "ON" position when a throttle valve mounted to the throttle body is fully closed, setting a duty for the solenoid valve when the full-close switch is switched from the "ON" position to an "OFF" position, to stationarily hold the duty as it is without causing variation in an adjusted value for the solenoid valve at a time when a switching operation of the full-close switch is carried out, and fixing, at a recognition of the control unit being of a state different from the normal state, the duty of the solenoid valve to a necessary value in order to perform an initial setting of the intake air amount.

* * * * *